US006716024B2

(12) United States Patent
Jon

(10) Patent No.: US 6,716,024 B2
(45) Date of Patent: Apr. 6, 2004

(54) SAFETY LIGHTER

(76) Inventor: Jong-Koo Jon, 209-508 Hyundai Apt., 311-126 Sangok, Bupyung, Incheon City (KR)

( * ) Notice: Subject to any disclaimer, the term of this patent is extended or adjusted under 35 U.S.C. 154(b) by 0 days.

(21) Appl. No.: 10/228,816

(22) Filed: Aug. 29, 2002

(65) Prior Publication Data

US 2004/0043346 A1 Mar. 4, 2004

(30) Foreign Application Priority Data

Aug. 27, 2001 (KR) ..... 2001-0051864

(51) Int. Cl.[7] ..... F23D 11/36
(52) U.S. Cl. ..... 431/153; 431/276
(58) Field of Search ..... 431/153, 273, 431/277, 276, 267, 274, 138

(56) References Cited

U.S. PATENT DOCUMENTS 5,735,294 A * 4/1998 McDonough et al. ..... 131/329
5,769,625 A * 6/1998 Sher ..... 431/153
5,957,680 A * 9/1999 Doucet et al. ..... 431/153
6,074,198 A * 6/2000 Rogelet ..... 431/153
6,220,853 B1 * 4/2001 Luo ..... 431/153

* cited by examiner

*Primary Examiner*—James C. Yeung
(74) *Attorney, Agent, or Firm*—Charles E. Baxley

(57) ABSTRACT

In a standard lighter, a flame is obtained by rotating driving wheels of a striker wheel onto a spark stone. A pair of brake discs are mounted on an axis of a wheel assembly. Each of the pair of brake discs has a same diameter as that of the driving wheels. The pair of brake discs rotate freely relative to the driving wheels. The axis is loosely mounted in mounting slots and can move vertically. A gas release lever has a pair of extension portions placed beneath the pair of brake discs to interrupt or stop rotation of the pair of brake discs. To rotate the driving wheels, a considerable amount of extra force is required to overcome frictional force on the pair of brake discs, and would reduce a risk of fire damage caused by a child's inadvertent activation.

4 Claims, 7 Drawing Sheets

SAFETY LIGHTER

BACKGROUND OF THE INVENTION

1. Field of the Invention

The present invention relates to a cigarette lighter. More particularly, the present invention relates to a safety cigarette lighter.

2. Description of the Prior Art

A cigarette lighter, as shown in FIG. 7, includes a gas container 100' topped by a carriage 200', an outlet valve 400', a pressing lever 500' for gas release, and a wheel assembly with an axis 320'. The axis 320' of the wheel assembly holds a striker wheel 310', which is in contact with a spring 610'-supported spark flint 600'. The striker wheel 310' is fixedly disposed between two driving wheels 300', each having a diameter larger than that of the striker wheel 310'. A supporting frame 210' and 220' with a pair of mounting slots is attached upwardly on the carriage 200', which pivotally receive the axis 320' of the wheel assembly.

When the user's thumb pushes down, the two driving wheels 300' rotate and cause the striker wheel 310' to engage the spark flint 600', producing a spark. At a same time, the pressing lever 500' will be pressed down, lifting the outlet valve 400' to release the gas that inflames the spark.

Although this type of lighter conveniently lights cigarettes, misuse by children may lead to fires and burn injuries. The object of the present invention is to prevent a cigarette lighter from being actuated inadvertently by making it difficult to use by young children, reducing the risk of fire damage and burn injury.

SUMMARY OF THE INVENTION

A safety lighter includes a gas container topped with a carriage, an outlet valve, a pressing lever for gas release, and a wheel assembly that contains an axis to hold a striker wheel. The striker wheel is connected to a spark flint by a compression spring, and is fixedly disposed between two driving wheels, each with a diameter larger than that of the striker wheel. A supporting frame with a pair of mounting slots is attached upwardly on the carriage. A pair of brake discs are mounted on the axis, between insides of the supporting frame and outsides of the two driving wheels. The axis is loosely mounted in the pair of mounting slots in the supporting frame so that it can pivotally and vertically move. A pair of brake devices are placed beneath the pair of brake discs to interrupt or stop rotation of the pair of brake discs when the pair of brake discs contact the pair of brake devices.

Each of the pair of brake discs has a same diameter as that of the two driving wheels. The pair of brake discs rotate freely relative to the two driving wheels. Each of the brake discs has a smooth rim surface.

The pair of mounting slots in the supporting frame have a first position and a second position.

The pair of brake devices are extension portions of the pressing lever, and are placed beneath the pair of brake discs. When the pair of brake discs are pressed down by the user's thumb, they contact the pair of brake devices, interrupting or stopping rotation of the pair of brake discs.

To actuate the lighter, the user presses and rotates both the two driving wheels and the pair of brake discs. This causes the axis to move to the second position of the pair of mounting slots in the supporting frame and the pair of brake discs to contact the pair of brake devices that interrupt or stop rotation of the pair of brake discs. A considerable amount of extra force by the user is required to rotate the two driving wheels enough to overcome frictional force of the pair of brake discs while interrupting or stopping the rotation system.

Children will find it difficult to rotate the two driving wheels. Therefore, such a lighter would greatly reduce fire damage or burn injuries caused by inadvertent activation by children.

DETAILED DESCRIPTION OF THE PREFERRED EMBODIMENTS

Figure 1:
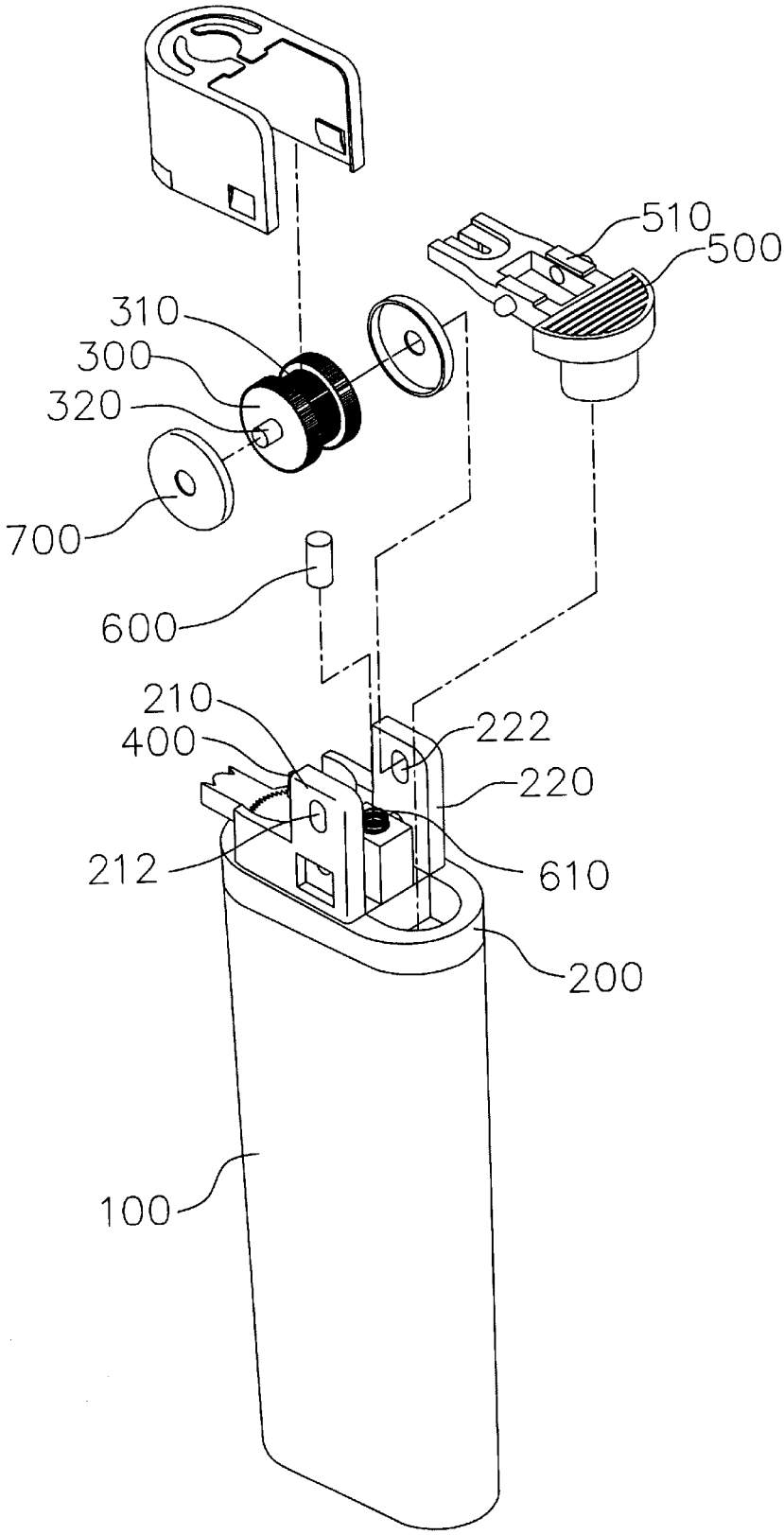
FIG. 1 is an exploded diagrammatic perspective view of the present invention.
Figure 2:
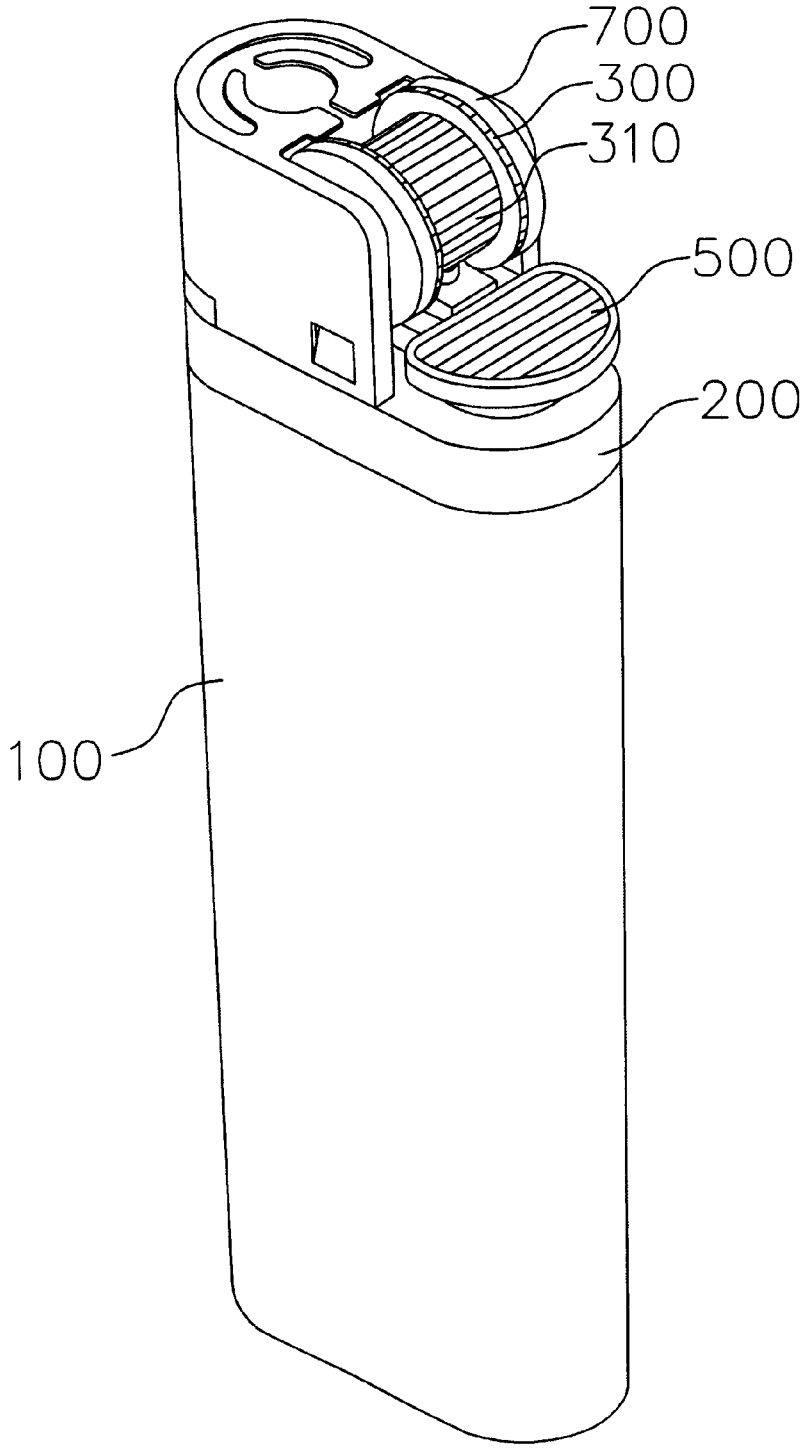
FIG. 2 is a diagrammatic perspective view of the present invention.
Figure 3:
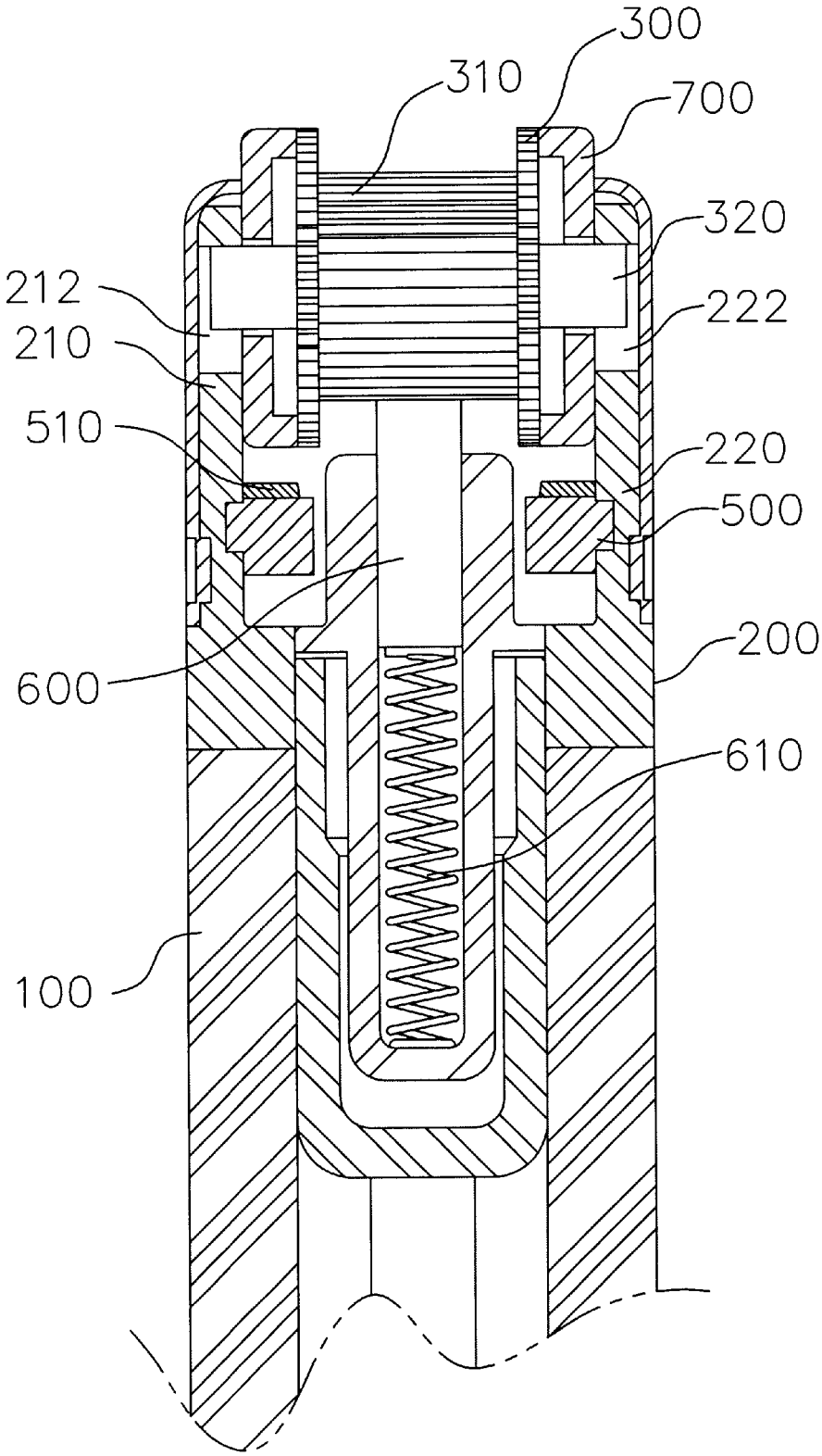
FIG. 3 is a diagrammatic cross sectional view of FIG. 2.

With reference to FIGS. 1–3, a safety lighter provided by the present invention comprises a gas container 100 topped by a carriage 200, an outlet valve 400, a pressing lever 500 for gas release, a wheel assembly containing an axis 320 and a striker wheel 310 which is in contact with a spring 610-supported spark flint 600, a supporting frame 210 and 220 with a pair of mounting slots 212 and 222 attached upwardly on the carriage, and a pair of brake discs 700. The striker wheel 310 is fixedly disposed between the two driving wheels 300, each has a diameter larger than that of the striker wheel 310. The pair of brake discs 700 are mounted on the axis 320 between insides of the supporting frame 210 and 220 and outsides of the two driving wheels 300. The axis 320 is loosely mounted in the mounting slots 212 and 222 in the supporting frame 210 and 220 and is allowed to pivotally and vertically move.

The pressing lever 500 has a pair of extension portions 510 located beneath the pair of brake discs 700 to interrupt or stop rotation of the pair of brake discs 700 when the pair of brake discs 700 contact the pair of extension portions 510 of the pressing lever 500.

Each of the pair of brake discs 700 has a same diameter as that of the two driving wheels 300. The pair of brake discs 700 have a smooth rim surface and rotate freely relative to the two driving wheels 300.

Figure 4:
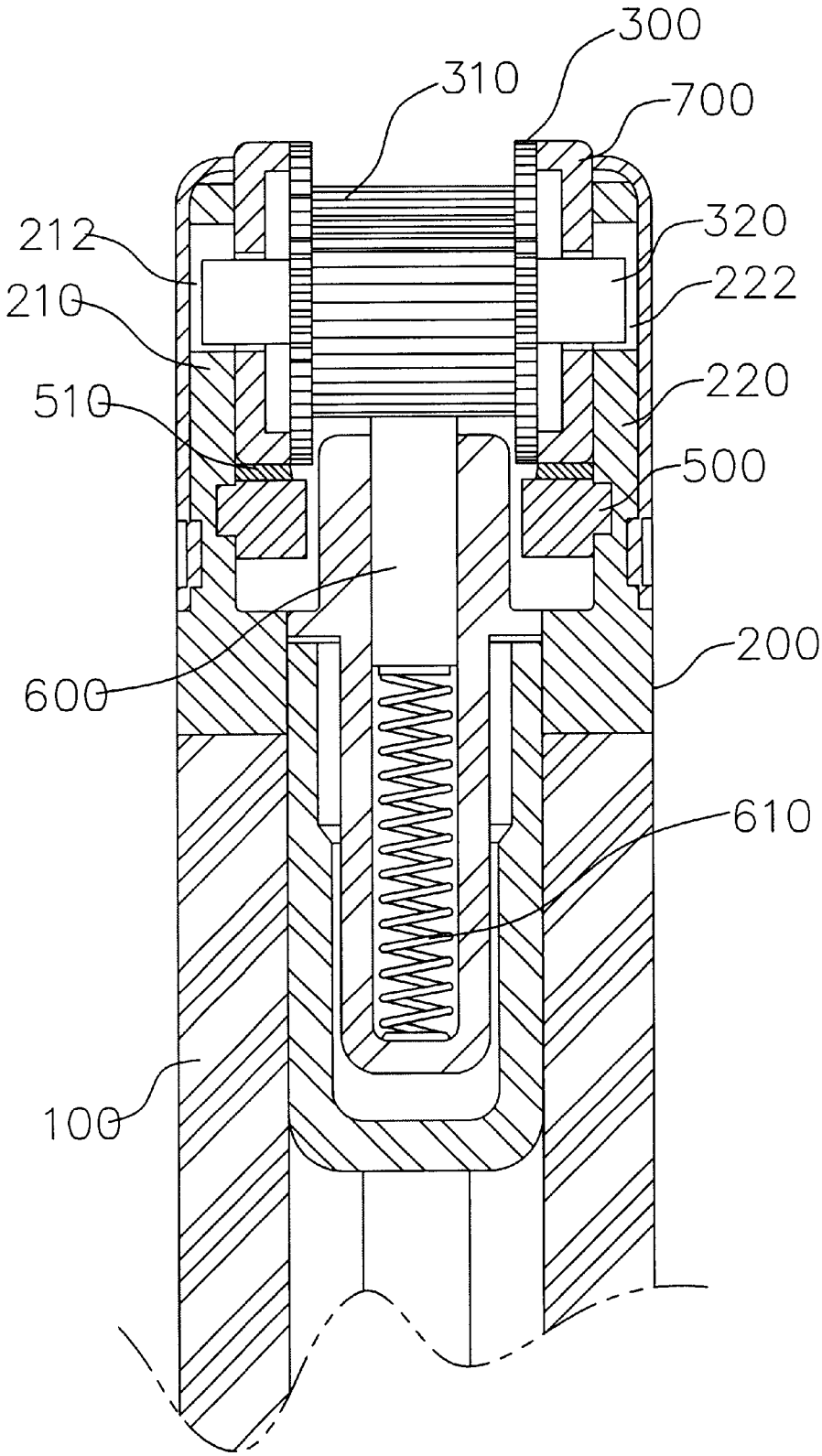
FIG. 4 is a diagrammatic cross sectional view showing operation of the present invention.

Referring to FIG. 4, when the user's thumb presses and rotates the two driving wheels 300 and the pair of brake discs 700, the axis 320 is moved from its first to its second position in the mounting slots 212 and 222 in the supporting frame 210 and 220. This causes the pair of brake discs 700 to contact the pair of extension portions 510 of the pressing lever 500, interrupting or stopping rotation of the pair of brake discs 700. To continue the rotation of the two driving wheels 300, the thumb must exert an additional amount of force to overcome frictional force of the pair of brake discs 700.

Figure 5:
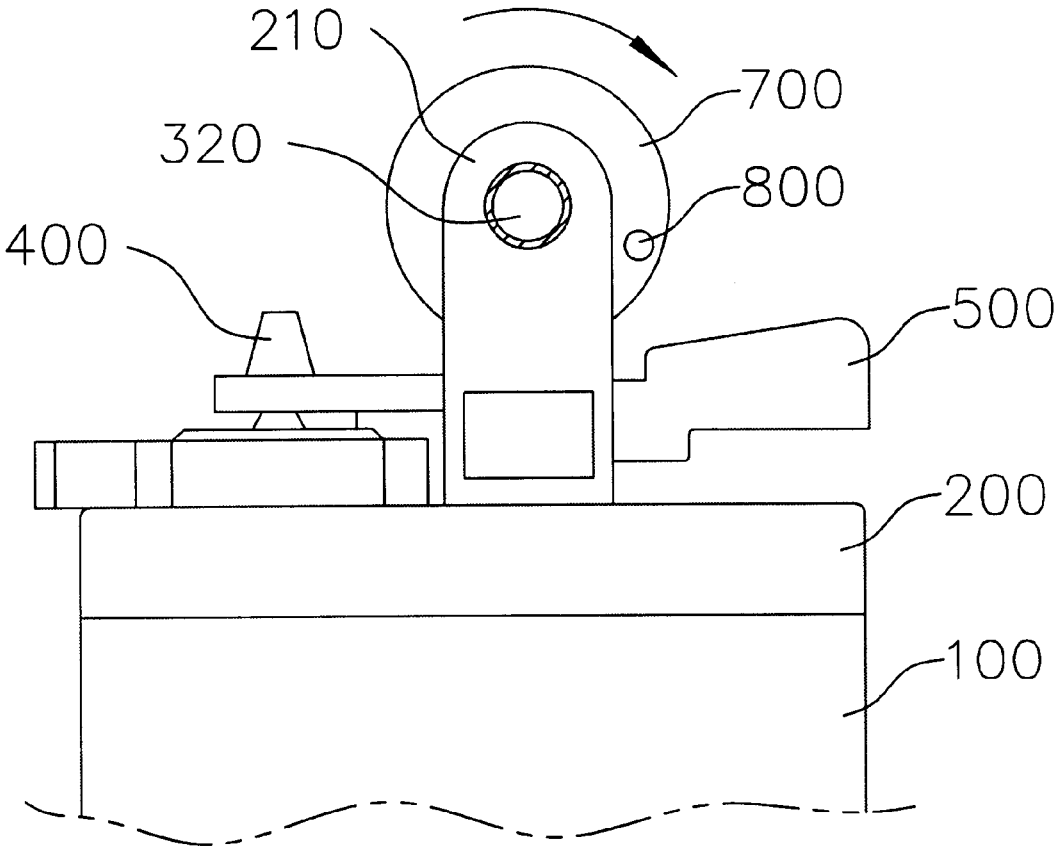
FIG. 5 is a diagrammatic side elevational view of a second embodiment of the present invention.
Figure 6:
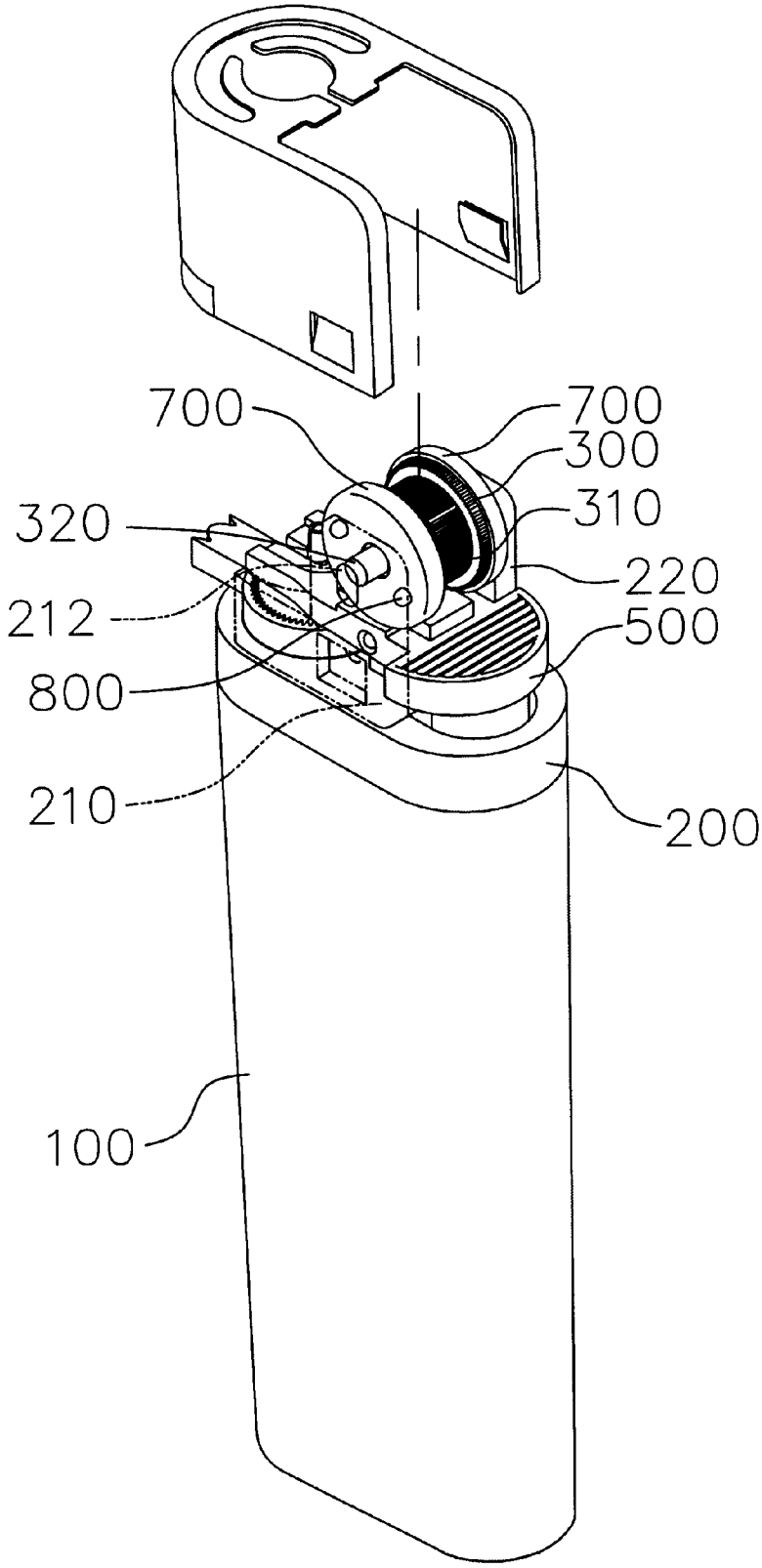
FIG. 6 is a partially exploded diagrammatic perspective view of the second embodiment of the present invention.
Figure 7:
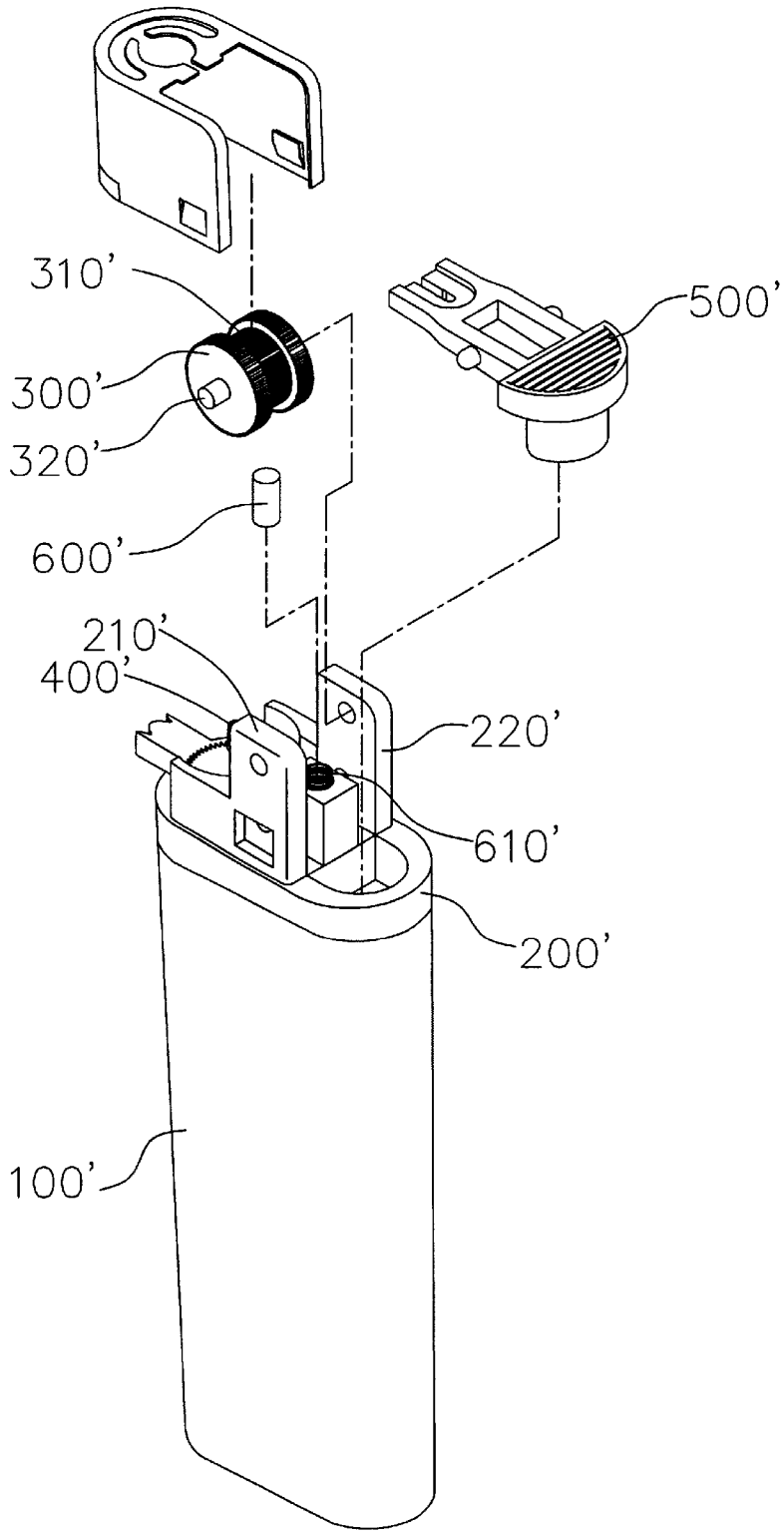
Prior Art FIG. 7
FIG. 7 is an exploded diagrammatic perspective view of a prior art lighter.

As shown in FIG. 5 and FIG. 6, a second embodiment of the present invention also has a pair of brake discs 700 with smooth rim surfaces, each with a same diameter as that of the two driving wheels 300. The pair of brake discs 700 are mounted on the axis 320, between the two driving wheels 300 and the supporting frame 210 and 220. Unlike the first embodiment of the present invention, however, the axis 320 of the wheel assembly does not move vertically. Each of the pair of brake discs 700 has a stopper 800 on its outside surface facing the supporting frame 210 and 220. The stoppers 800 serve to prevent rotation of the pair of brake discs 700.

What is claimed is:

1. A safety lighter, comprising:

a) a gas container;

b) a carriage;

c) an outlet valve;

d) a pressing lever;

e) a wheel assembly;

f) a spring-supported spark flint;

g) a supporting frame;

h) two driving wheels;

i) a pair of brake discs; and j) a pair of brake devices;

wherein the gas container has a top;

wherein the carriage is on the top of the gas container;

wherein the outlet valve is on the top of the gas container;

wherein the pressing lever is on the top of the gas container;

wherein the pressing lever is for gas release;

wherein the wheel assembly is on the top of the gas container;

wherein the wheel assembly has an axis;

wherein the axis of the wheel assembly holds the striker wheel;

wherein the striker wheel contacts the spring-supported flint;

wherein the supporting frame has a pair of mounting slots;

wherein the pair of mounting slots in the supporting frame are attached upwardly on the carriage;

wherein the striker wheel is fixedly disposed between the two driving wheels;

wherein each of the two driving wheels has a diameter larger than that of the striker wheel;

wherein the pair of brake discs are mounted on the axis;

wherein the supporting frame has insides;

wherein the two driving wheels have outsides;

wherein the pair of brake discs are mounted between the insides of the supporting frame and the outsides of the two driving wheels;

wherein the axis is loosely mounted in the pair of mounting slots in the supporting frame;

wherein the axis is allowed to pivotally and vertically move;

wherein the pair of brake devices are placed at one of beneath the pair of brake discs and between the pair of brake discs and the supporting frame;

wherein the pair of brake devices do one of interrupt and stop rotation of the pair of brake discs when the pair of brake discs contact the pair of brake devices;

wherein each of the pair of brake discs has a same diameter as that of the two driving wheels; and wherein each of the pair of brake discs rotate freely relative to the two driving wheels.

2. The safety lighter as defined in claim 1 wherein the pair of brake devices comprise a pair of extension portions of the pressing lever; and wherein the pair of extension portions of the pressing lever are placed beneath the pair of brake discs.

3. The safety lighter as defined in claim 1, wherein each of the pair of brake discs has a smooth rim surface.

4. The safety lighter as defined in claim 1, wherein the pair of mounting slots in the supporting frame have a first position; and wherein the pair of mounting slots in the supporting frame have a second position.

* * * * *